US011578380B2

(12) United States Patent
Zhang et al.

(10) Patent No.: US 11,578,380 B2
(45) Date of Patent: Feb. 14, 2023

(54) ULTRAHIGH-STRENGTH HOT-ROLLED STEEL SHEET AND STEEL STRIP HAVING GOOD FATIGUE AND REAMING PROPERTIES AND MANUFACTURING METHOD THEREFOR

(71) Applicant: BAOSHAN IRON & STEEL CO., LTD., Shanghai (CN)

(72) Inventors: Hanlong Zhang, Shanghai (CN); Yulong Zhang, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 51 days.

(21) Appl. No.: 17/256,080

(22) PCT Filed: Jun. 25, 2019

(86) PCT No.: PCT/CN2019/092766

§ 371 (c)(1),
(2) Date: Dec. 24, 2020

(87) PCT Pub. No.: WO2020/001430

PCT Pub. Date: Jan. 2, 2020

(65) Prior Publication Data

US 2021/0269891 A1 Sep. 2, 2021

(30) Foreign Application Priority Data

Jun. 27, 2018 (CN) ..... 201810681968.3

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/38*** | (2006.01) |
| ***C22C 38/28*** | (2006.01) |
| ***C22C 38/26*** | (2006.01) |
| ***C22C 38/22*** | (2006.01) |
| ***C22C 38/06*** | (2006.01) |
| ***C22C 38/02*** | (2006.01) |
| ***C22C 38/00*** | (2006.01) |

(52) U.S. Cl.

CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01)

(58) Field of Classification Search

None

See application file for complete search history.

(56) References Cited

U.S. PATENT DOCUMENTS

2010/0221573 A1 9/2010 Drillet et al.

FOREIGN PATENT DOCUMENTS

| | | | |
|---|---|---|---|
| CN | 101035921 | A | 9/2007 |
| CN | 101784688 | A | 7/2010 |
| CN | 101928875 | A | 12/2010 |
| CN | 107849663 | A | 3/2018 |
| JP | 2010533791 | A | 10/2010 |
| WO | 2017050790 | A | 3/2017 |

OTHER PUBLICATIONS

JP Office Action for 2020-571425.

International Search Report and Written Opinion dated Sep. 27, 2019 in PCT Application No. PCT/CN2019/092766.

*Primary Examiner* — Anthony M Liang

(74) *Attorney, Agent, or Firm* — Lei Fang, Esq.; Smith Tempel Blaha LLC

(57) ABSTRACT

An ultra-high-strength hot-rolled steel plate and steel strip having good fatigue and reaming properties and a manufacturing method therefor. The weight percentages of the components of the steel plate and the steel strip are: C: 0.07-0.14%, Si: 0.1-0.4%, Mn: 1.55-2.00%, P≤0.015%, S≤0.004%, Al: 0.01-0.05%, N≤0.005%, Cr: 0.15-0.50%, V: 0.1-0.35%, Nb: 0.01%-0.06%, Mo: 0.15-0.50%, Ti≤0.02%, and the balance of Fe and unavoidable impurities. Such components need to meet: 1.0≤[(Cr/52)/(C/4)+(Nb/93+Ti/48+V/51+Mo/96)/(C/12)]≤1.6. The tensile strength of the ultrahigh-strength hot-rolled steel plate and steel strip is ≥780 MPa, the yield strength thereof is ≥660 MPa, the tensile fatigue limit (10 million cycles) FL thereof is ≥570 MPa, or the fatigue limit to tensile strength FL/Rm thereof is ≥0.72. The reaming rate meets: if an original hole is a punched hole, the reaming rate thereof is >85%; and if the original hole is a reamed hole, the reaming rate thereof is >120%.

16 Claims, 1 Drawing Sheet

ULTRAHIGH-STRENGTH HOT-ROLLED STEEL SHEET AND STEEL STRIP HAVING GOOD FATIGUE AND REAMING PROPERTIES AND MANUFACTURING METHOD THEREFOR

CROSS-REFERENCE TO RELATED APPLICATIONS

This application is a 371 U.S. National Phase of PCT International Application No. PCT/CN2019/092766 filed on Jun. 25, 2019, which claims benefit and priority to Chinese patent application no. CN 201810681968.3 filed on Jun. 27, 2018, the contents of both are incorporated by reference herein in their entiries.

TECHNICAL FIELD

The present disclosure pertains to the field of metal materials, and particularly relates to an ultra-high-strength hot-rolled steel plate and an ultra-high-strength hot-rolled steel strip with good fatigue and reaming performances, and a manufacturing method for the same, mainly useful for manufacturing automobile chassis, suspension parts and other products.

BACKGROUND ART

"Lightweight" of automobiles can directly reduce emissions and reduce fuel consumption, which is a goal of development in today's automobile manufacturing industry. An important measure for "lightweight" of automobiles is to replace mild steel with high-strength and ultra-high-strength steel plates. The use of high-strength steel in a large scale may effect a weight reduction of 20-25%. In the past ten years, advanced high-strength steel with both high strength and high elongation has been widely used in body-in-white structural parts to achieve "lightweight", and excellent energy saving and emission reduction effects have been achieved. At present, the concept of "lightweight" is further applied to automobile chassis and suspension systems. The increasingly stringent environmental requirements and market demands also require the use of high-strength steel as an automobile chassis material to achieve "lightweight".

However, for the structural parts of an automobile chassis and a suspension system, the forming process requires the material to have a high reaming performance. In addition, the service characteristics of the structural parts of the chassis and suspension system also further require the material to have high fatigue performance. Although high-strength steel comprising a major structure of bainite has become a common steel grade for automobile chassis and suspension system parts due to its high strength and good reaming performance, it is extremely difficult to design and manufacture a steel material having high strength, good reaming performance and good fatigue performance at the same time, because the composition and structure of bainite steel are complex, and the three properties of high strength, high reaming rate and high fatigue limit restrict each other.

Chinese Patent Application No. CN102612569A discloses a high-strength hot-rolled steel plate with a tensile strength of greater than 780 MPa, a bending fatigue limit ratio of greater than 0.45 for 10 million loading cycles, and a reaming rate (the original hole is a punched hole) of 30-50%. Although the steel plate has a relatively high strength and a certain bending fatigue limit, the reaming rate is relatively low.

Chinese Patent Application No. CN103108971A discloses a high-strength hot-rolled steel plate with excellent fatigue resistance. The steel plate has a tensile strength of greater than 780 MPa and a tensile fatigue limit of 0.66 to 0.78 for 2 million loading cycles. However, this fatigue limit is only a fatigue limit under 2 million loading cycles. According to common knowledge, the fatigue limit is inversely proportional to the number of cycles. Therefore, if the number of loading cycles in the fatigue testing of this material is further increased, the fatigue limit will be further reduced. In addition, the reaming performance of the material is not considered in this patent application.

Chinese Patent Application No. CN101906567A discloses a high-strength hot-rolled steel plate with excellent reaming workability, wherein the tensile strength of the steel plate is greater than 780 MPa, and the reaming rate (the original hole is a punched hole) is between 43-89%. Chinese Patent Application No. CN104136643A discloses a high-strength hot-rolled steel plate with a tensile strength of greater than 780 MPa and a reaming rate (the original hole is a reamed hole) between 37% and 103%. However, neither of the above two patent applications considers the fatigue performance of the material.

In the aforementioned four patent applications, the Ti element is an optional or mandatory beneficial element to increase the strength of the material or inhibit the growth of original austenite grains. However, the Ti element will react at high temperatures with the N element, a common impurity in steel, to form large, brittle, and sharp-edged TiN particles in a square (or triangular) shape. These particles have a harmful influence on the forming performances of the steel, such as bending and reaming, and will reduce the fatigue limit of the steel material greatly. These adverse effects caused by the Ti element are not considered in the prior art.

In addition, for this type of material that has a tensile strength of the 800 MPa level, and comprises bainite as the main structure and carbide precipitates as the reinforcing phase (hereinafter referred to as this type of material), the strength, fatigue limit and reaming performance are three performances that restrict each other. First of all, the strength of the material is usually inversely proportional to the reaming performance. In order to obtain higher strength, especially yield strength, this type of steel urgently needs the precipitation strengthening effect of carbides. However, the precipitation and coarsening of a large amount of carbides will greatly impair the reaming performance of the material. In addition, generally speaking, the higher the yield strength of the material, the higher the fatigue limit of the material. However, for this type of material, the improvement of the yield strength greatly depends on the precipitation of a large amount of carbides, but the precipitation and coarsening of a large amount of carbides will also greatly reduce the fatigue limit of this type of material. Therefore, it is extremely difficult to design and manufacture this kind of material to achieve high strength, high reamability and high fatigue limit.

SUMMARY

One object of the present disclosure is to provide an ultra-high-strength hot-rolled steel plate and an ultra-high-strength hot-rolled steel strip with good fatigue and reaming performances and a manufacturing method for the same. The steel plate has a tensile strength ≥780 MPa; a yield strength ≥660 MPa; a reaming rate performance index: a reaming rate >85% if the original hole is a punched hole; or a reaming rate>120% if the original hole is a reamed hole; and a fatigue resistance performance index: a high frequency fatigue limit (10 million cycles) FL≥570 MPa, or a ratio of fatigue limit to tensile strength FL/Rm≥0.72. More preferably, the steel plate has a tensile strength ≥780 MPa, a yield strength ≥660 MPa, a tensile fatigue limit (10 million cycles) FL≥600 MPa, or a ratio of fatigue limit to tensile strength FL/Rm≥0.75; and the reaming rate satisfies: the reaming rate is >85% if the original hole is a punched hole; the reaming rate is >120% if the original hole is a reamed hole. The ultra-high-strength hot-rolled steel plate and steel strip of the present disclosure are mainly used for manufacture of automobile chassis and suspension system components.

To achieve the above object, the technical solution of the disclosure is as follows:

An ultra-high-strength hot-rolled steel plate and an ultra-high-strength hot-rolled steel strip with good fatigue and reaming performances, with its composition based on weight percentage being: C: 0.07-0.14%, Si: 0.1-0.4%, Mn: 1.55-2.00%, P≤0.015%, S≤0.004%, Al: 0.01-0.05%, N≤0.005%, Cr: 0.15-0.50%, V: 0.1-0.35%, Nb: 0.01%-0.06%, Mo: 0.15-0.50%, and Ti≤0.02%, and a balance of Fe and unavoidable impurities, wherein the above elements meet the following relationship: $1.0 \leq [(Cr/52)/(C/4)+(Nb/93+Ti/48+V/51+Mo/96)/(C/12)] \leq 1.6$ based on weight percentage.

Preferably, in the chemical composition of the ultra-high-strength hot-rolled steel plate and steel strip, C: 0.07-0.09% based on weight percentage.

Preferably, in the chemical composition of the ultra-high-strength hot-rolled steel plate and steel strip, Si: 0.1-0.3% based on weight percentage.

Preferably, in the chemical composition of the ultra-high-strength hot-rolled steel plate and steel strip, Mn: 1.70-1.90% based on weight percentage.

Preferably, in the chemical composition of the ultra-high-strength hot-rolled steel plate and steel strip, Cr: 0.35-0.50% based on weight percentage.

Preferably, in the chemical composition of the ultra-high-strength hot-rolled steel plate and steel strip, V: 0.12-0.22% based on weight percentage.

Preferably, in the chemical composition of the ultra-high-strength hot-rolled steel plate and steel strip, Mo: 0.15-0.3% based on weight percentage.

Preferably, in the chemical composition of the ultra-high-strength hot-rolled steel plate and steel strip, Nb: 0.02-0.05% based on weight percentage.

Preferably, in the chemical composition of the ultra-high-strength hot-rolled steel plate and steel strip, Al: 0.02-0.04% based on weight percentage.

Preferably, in the chemical composition of the ultra-high-strength hot-rolled steel plate and steel strip, Ti≤0.005%, based on weight percentage.

Preferably, in the chemical composition of the ultra-high-strength hot-rolled steel plate and steel strip, Ti≤0.003%, N≤0.003%, based on weight percentage.

Further, the ultra-high-strength hot-rolled steel plate and steel strip have a tensile strength ≥780 MPa; a yield strength ≥660 MPa; a reaming rate performance index: a reaming rate >85% if the original hole is a punched hole; or a reaming rate>120% if the original hole is a reamed hole; and a fatigue resistance performance index: a high frequency fatigue limit (10 million cycles) FL≥570 MPa, or a ratio of fatigue limit to tensile strength FL/Rm≥0.72.

More preferably, the ultra-high-strength hot-rolled steel plate and steel strip have a high frequency fatigue limit (10 million cycles) FL≥600 MPa, or a ratio of fatigue limit to tensile strength FL/Rm≥0.75.

Preferably, the ultra-high-strength hot-rolled steel plate and steel strip have a high frequency fatigue limit (10 million cycles) FL≥640 MPa, or a ratio of fatigue limit to tensile strength FL/Rm≥0.8.

Preferably, the ultra-high-strength hot-rolled steel plate and steel strip have an A50≥15.0%, more preferably ≥16.0%.

Preferably, the ultra-high-strength hot-rolled steel plate and steel strip have a reaming rate performance index: a reaming rate >90% if the original hole is a punched hole; or a reaming rate>125% if the original hole is a reamed hole.

The microstructure in the ultra-high-strength hot-rolled steel plate and steel strip according to the present disclosure is a bainite microstructure dominated by lower bainite.

In the compositional design of the steel according to the present disclosure:

Carbon (C): Carbon has a great influence on the strength, formability and weldability of the steel plate. Carbon and other alloying elements form alloy carbides to increase the strength of the steel plate. If the carbon content is less than 0.07%, the strength of the steel will not meet the target requirements; if the carbon content is higher than 0.14%, martensite structure and coarse cementite tend to form to reduce the elongation and reaming rate. Therefore, the carbon content is controlled in the range of 0.07-0.14% according to the present disclosure. In a preferred embodiment, the C content is in the range of 0.07-0.09%.

Silicon (Si): Silicon is an essential element for deoxygenation in steelmaking, and it also has a certain solid solution strengthening effect. When the silicon content is less than 0.1%, it is difficult to achieve a full deoxygenating effect; when the silicon content is higher than 0.5%, a polygonal ferrite structure tends to form, which is not good for improving the reaming rate, and deteriorates platability, unfavorable for production of hot-dip galvanized steel plates. Therefore, the silicon content is limited to the range of 0.1-0.4% according to the present disclosure. In a preferred embodiment, the Si content is in the range of 0.1-0.3%.

Manganese (Mn): Manganese is an effective element for improving strength and is low in cost. Therefore, manganese is used as a main additive element according to the present disclosure. However, when the manganese content is higher than 2.00%, a large amount of martensite is formed, which is not good for the reaming performance; when the manganese content is lower than 1.55%, the strength of the steel plate is insufficient. Therefore, the manganese content is limited to 1.55-2.00% according to the present disclosure. In a preferred embodiment, the Mn content is in the range of 1.7-1.9%.

Aluminum (Al): Aluminum has an effect of deoxygenation in steelmaking. It's an element that is added for increasing the purity of molten steel. Aluminum can also immobilize nitrogen in steel to form stable compounds, and effectively refine crystal grains. However, when the aluminum content is less than 0.01%, the effect is insignificant; when the aluminum content exceeds 0.05%, the deoxygenating effect is saturated, and an even higher content has a negative impact on the base material and the welding heat affected zone. Therefore, the aluminum content is limited to 0.01-0.05% according to the present disclosure. In a preferred embodiment, the Al content is in the range of 0.02-0.04%.

Niobium (Nb): Niobium can effectively delay recrystallization of deformed austenite, prevent austenite grains from growing large, increase the recrystallization temperature of austenite, refine grains and promote both strength and elongation. However, when the niobium content is higher than 0.06%, the cost will increase and the effect will no longer be significant. Therefore, the niobium content is limited to 0.06% or less according to the present disclosure. In a preferred embodiment, the Nb content is in the range of 0.02-0.05%.

Vanadium (V): The role of vanadium is to increase the strength of steel by forming carbide precipitates together with solid solution strengthening. However, when the vanadium content is higher than 0.35%, the effect of further increasing its content is not significant. When the V content is less than 0.10%, the precipitation strengthening effect is not significant. Therefore, the vanadium content is limited to 0.1-0.35% according to the present disclosure. In a preferred embodiment, the V content is in the range of 0.12-0.22%.

Chromium and molybdenum (Cr, Mo): Chromium and molybdenum prolong the incubation period of pearlite and ferrite in the CCT curve, inhibit the formation of pearlite and ferrite, and make it easier to obtain the bainite structure during cooling, which is beneficial to improve the reaming rate. At the same time, chromium and molybdenum contribute to the refinement of austenite grains and the formation of fine bainite during rolling, and improve the steel strength by solid solution strengthening and carbide precipitation. However, if the addition amount exceeds 0.5%, the cost is increased, and the weldability is significantly reduced. When the content of Cr and Mo is less than 0.15%, the influence on the CCT curve is not significant. Therefore, the chromium and molybdenum content is limited to 0.15-0.5% according to the present disclosure. In a preferred embodiment, the Cr content is in the range of 0.35-0.50%. In a preferred embodiment, the Mo content is in the range of 0.15-0.30%.

It should be understood that the content ranges of the various elements described herein can be combined with each other to constitute one or more preferred technical solutions according to the present disclosure.

In addition, the relationship between the amounts of the above alloying elements and the carbon element should further satisfy the following formula: $1.0 \leq [(Cr/52)/(C/4)+(Nb/93+Ti/48+V/51+Mo/96)/(C/12)] \leq 1.6$. The addition of the alloying elements can improve the strength of the material by the solid solution strengthening effect and the carbide precipitation effect. However, compared with solid solution strengthening, the effect of carbide precipitation has a greater negative impact on the reaming performance and the fatigue limit. The more the alloying elements, the easier for them to combine with the carbon element in the steel in a large quantity to form a precipitation phase of coarse carbide. Therefore, the ratios of the alloying elements and the carbon element need to fall in the range set by the above formula to ensure that the material can simultaneously obtain the strength and the reaming performance that meet the designed standards.

Titanium (Ti): Titanium is a harmful element that reduces the fatigue limit in the present disclosure. Although the addition of the Ti element can increase the strength of this type of steel, it results in large, brittle, and sharp-edged TiN particles, and thus becomes a potential source of fatigue cracks which can greatly reduce the fatigue performance of the steel. Moreover, the higher the content of the Ti element, the larger the size of the resulting TiN particles, and the severer the adverse effect on the fatigue performance. In addition, the addition of a large amount of the Ti element will also lead to precipitation of a large amount of coarse TiC, impairing the reaming performance. Therefore, it is necessary to strictly control the upper limit of the Ti element content. In the case that no Ti is introduced additionally, it's required that Ti is ≤0.02%; preferably, it's required that Ti is ≤0.005%.

The upper limits of the impurity elements in the steel are controlled at P: ≤0.015%, S: ≤0.004%, N: ≤0.005%. The purer the steel, the better the effect. Furthermore, in order to obtain the highest fatigue limit, when the Ti element content is guaranteed to be less than 0.003%, the N element content is required to be ≤0.003%.

The method for manufacturing the ultra-high-strength hot-rolled steel plate and steel strip with good fatigue and reaming performances according to the present disclosure includes the following steps:

1) Smelting and Casting

Smelting and casting the above chemical composition into a cast blank;

2) Rolling

Heating the cast blank at a heating temperature of 1100-1250° C.; and finish rolling with an initial rolling temperature being 950-1000° C., and a final rolling temperature being 900-950° C.;

3) Cooling, Coiling

Water cooling the rolled blank at a cooling rate ≥30° C./s; and coiling at a coiling temperature of 450-580° C.;

4) Pickling.

Further, after the cooling and coiling in Step 3), heat insulation and slow cooling are performed, and then the pickling is performed. In the heat insulation and slow cooling step, the temperature is controlled at 450° C. or higher for 2-4 hours. For the heat insulation and slow cooling, the hot-rolled coil may be placed in a non-heating heat insulation device to keep the temperature at 450° C. or higher for 2-4 hours.

In Step 2) as described above, the temperature at which the slab is heated influences the austenite grain size. In the manufacture of ultra-high-strength complex-phase steel, the added alloying elements such as V and Nb form carbides to increase the strength of the steel plate. When the slab is heated, these alloying elements must be dissolved into austenite to form a complete solid solution, and then fine carbides or nitrides can be formed in the subsequent cooling process and play a strengthening role. Therefore, the temperature for heating the slab is limited to 1100-1250° C. according to the present disclosure.

In Step 2) as described above, when the final rolling temperature of the finish rolling is not less than 900° C., a fine and uniform structure can be obtained. When the final rolling temperature of the finish rolling is lower than 900° C., the banded structure formed during hot working will be retained, which is unfavorable for improving the reaming performance. Therefore, the final rolling temperature of the finish rolling is limited to not less than 900° C. Generally, it's not necessary to specify the upper limit of the final rolling temperature. Nevertheless, with the temperature for heating the slab taken into account, the final rolling temperature of the finish rolling does not exceed 950° C.

In Step 3) as described above, the cooling rate is limited to not less than 30° C./s for the purpose of preventing transformation of super-cooled austenite into polygonal ferrite or pearlite and precipitation of carbides at high temperatures, thereby forming a microstructure dominated by lower bainite.

In Step 3) as described above, the coiling temperature is one of the most critical process parameters for obtaining high strength, high reaming rate and high fatigue limit. When the coiling temperature is higher than 580° C., the strength of ferrite is reduced due to the strong precipitation and coarsening of alloy carbides, which has a negative effect on the reaming rate and fatigue limit of the steel plate. On the other hand, when the coiling temperature is lower than 450° C., martensite structure will be formed in a relatively large amount. Although it can increase the strength of the material, it has an adverse influence on the reaming rate. Therefore, the coiling temperature is limited to 450-580° C. according to the present disclosure.

Further, the tensile strength of this type of steel can be further improved by the method of hot rolling and heat insulation. Specifically, after coiling, the hot coil is placed in a heat insulation pit, and the heat of the hot coil itself is used for heat insulation and slow cooling. Heat insulation at 450° C. or higher for 2-4 hours can promote fine and dispersive precipitation of vanadium carbide, thereby significantly improving the strength of the material according to the present disclosure, and at the same time, it will not reduce the reaming rate or the fatigue limit significantly. In the heat insulation process for the hot coil, the minimum heat insulation temperature and the heat insulation time influence the performances of the final product. If the heat insulation temperature is lower than 450° C., the force driving the precipitation of vanadium (molybdenum) carbide is insufficient, and fine and dispersive precipitation of vanadium (molybdenum) carbide will not occur. If the heat insulation time is shorter than 2 h, the precipitation of vanadium (molybdenum) carbide is limited, and the strength of this type of steel cannot be improved; and if the heat insulation time is longer than 4 h, the precipitated vanadium (molybdenum) carbide will grow and coarsen, thereby significantly reducing the reaming rate and fatigue limit of this type of steel.

The primary requirements of automobile chassis and suspension system components on materials are high strength and high reaming performance. In order to achieve a strength of at least 780 MPa and a reaming rate of at least 60% (the original hole is a punched hole), a steel grade comprising a ferrite structure or a ferrite plus bainite structure (in which the content of the bainite structure is greater than 50%) is generally used at present. Because the ferrite matrix is relatively soft, it is usually necessary to add more alloying elements to allow for strengthening of the ferrite matrix by solid solution and fine alloy carbides, so as to obtain relatively high strength. In the prior art, the Ti element is used as a mandatory or optional beneficial element to improve the strength of this type of steel. However, the Ti element and the N element in the steel will form large, brittle, and sharp-edged TiN particles at high temperatures. These particles are not conducive to the reaming performance of this type of steel. In addition, as the requirement of automobile chassis components on the fatigue performance of a steel material becomes higher and higher, the research according to the present disclosure proves that the large, brittle, and sharp-edged TiN particles will become a potential source of fatigue cracks, and thus will greatly reduce the fatigue limit of this type of steel. Moreover, the research has found that TiN particles are generated during steelmaking and continuous casting (or die casting), and subsequent processes can hardly change the size or morphology of the TiN particles, let alone eliminating the TiN particles. Therefore, in order to obtain higher reaming performance and fatigue performance, the content of the Ti element in this type of steel should be minimized.

Hence, a concept for designing a composition with no Ti element is adopted according to the present disclosure, wherein no Ti element is added, and the Ti content in the steel is strictly controlled to reduce formation of TiN particles, so as to obtain a high fatigue limit. Meanwhile, a high-strength hot-rolled steel plate having a high strength, a high reaming rate and a high fatigue limit at the same time is obtained by a Mo—V combination and optimization of the manufacturing process. The structure of the steel plate adopts a bainite microstructure dominated by lower bainite to ensure the strength and toughness of the steel plate. In the microstructure of the steel plate according to the present disclosure, the content (by volume) of the lower bainite structure ranges from 30% to 70%. When the content of the lower bainite structure is less than 30%, the strength of the steel plate cannot meet the design requirement; when the content of the lower bainite structure is higher than 70%, the plasticity and reaming performance of the steel plate will be degraded. In some embodiments, the content of the lower bainite structure in the microstructure of the steel plate according to the present disclosure is 40%-70%. By adding alloying elements Cr and Mo to shift the ferrite transformation region to the right, the critical cooling rate can be reduced, and the lower bainite structure can be obtained easily. In addition to bainite, the microstructure of the steel plate according to the present disclosure may also include ferrite, carbide precipitates and optionally tempered martensite. By adding alloying elements Mo, V, Nb to refine the grains, dispersive and fine carbides are generated, so as to further improve the strength of the steel. However, if excessive carbides precipitate, they will further coarsen, which not only is not conducive to further improvement of the strength, but also reduces the reaming performance and fatigue limit of the steel. Therefore, it is necessary to optimize the hot rolling process to obtain alloy carbides which are finely and dispersively distributed, so as to achieve the purpose of improving the reaming performance. In some embodiments, in the microstructure of the steel plate according to the present disclosure, the sum of the contents of the lower bainite structure and the ferrite structure is ≥80%, wherein the content of the lower bainite structure is ≥40%.

Upon testing, the performances of the ultra-high-strength hot-rolled steel plate and steel strip provided according to the present disclosure meet the following standards:

Mechanical Performances at Ambient Temperature:

Tensile strength ≥780 MPa; yield strength ≥660 MPa.

Reaming Rate Performance:

If the original hole is a punched hole: the reaming rate is greater than 85%;

If the original hole is a reamed hole: the reaming rate is greater than 120%.

Anti-Fatigue Performance:

High frequency fatigue limit (10 million cycles) FL≥570 MPa;

Or a ratio of fatigue limit to tensile strength FL/Rm≥0.72.

When Ti is ≤0.005% in the steel composition, the anti-fatigue performance meets the following standards:

High frequency fatigue limit (10 million cycles) FL≥600 MPa; Or a ratio of fatigue limit to tensile strength FL/Rm≥0.75.

When Ti is ≤0.003% and N is ≤0.003% in the steel composition, the anti-fatigue performance meets the following standards:

High frequency fatigue limit (10 million cycles) FL≥640 MPa; or

A ratio of fatigue limit to tensile strength FL/Rm≥0.8.

The ultra-high-strength hot-rolled steel plate and steel strip manufactured according to the present disclosure have high strength, high reaming performance and high fatigue limit. The ultra-high-strength hot-rolled steel plate and steel strip products are hot-dip galvanized to obtain final hot-rolled hot-galvanized steel plate products. The ultra-high-strength hot-rolled steel plate products and steel strip products as well as the final hot-galvanized steel plate products can be used to manufacture automobile chassis and suspension system components to realize automobile "light-weight".

DETAILED DESCRIPTION

Figure 1:
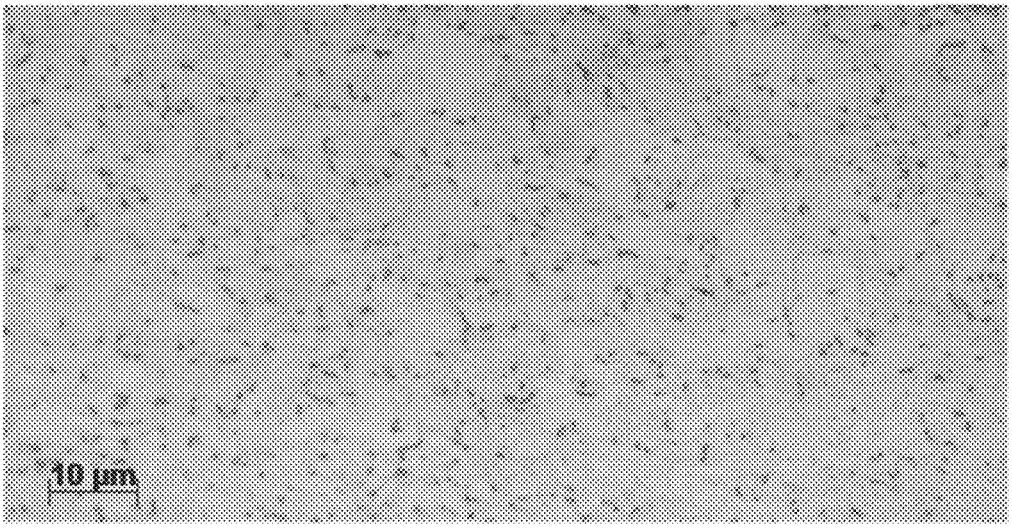
FIG. 1 is a photo showing the microstructure of the Example G-1 steel according to the present disclosure (magnification: 1000).

The disclosure will be further illustrated with reference to the following specific Examples. The steel materials of different compositions shown in Table 1 were smelted, and then subjected to the heating+hot rolling process as shown in Table 2 to obtain steel plates having a thickness of less than 4 mm. Transverse JIS 5# tensile samples were prepared to measure the yield strength and tensile strength. Central parts of the plates were taken to measure the reaming rate and fatigue limit. Transverse samples were used for the fatigue limit measurement. As regards the sample dimensions and experimental methods, reference was made to GB 3075-2008 Metal Axial Fatigue Testing Method. The test data are shown in Table 2. The reaming rate was measured using a reaming test, wherein a test piece with a hole in the center was pressed into a die with a punch to expand the central hole of the test piece until the edge of the hole in the plate necked or through-plate cracks appeared. Due to the great influence of the way for forming the original hole in the center of the test piece on the test results of the reaming rate, punching and reaming were used to form the original hole in the center of the test piece respectively. The subsequent tests and test methods were performed according to the reaming rate test method as specified in the ISO/DIS 16630 standard. The fatigue limit was measured according to the axial high-frequency tensile fatigue test. Particularly, the GB 3075-2008 metal axial fatigue test method was used, wherein the test frequency was 85 Hz. The maximum strength of the sample having no failure after 10 million cycles of loading was taken as the fatigue limit RL.

In Table 1, Examples A to H are the inventive steel compositions, while the contents of carbon or manganese or other alloying elements in Comparative Examples J to P are outside of the corresponding ranges defined for the inventive compositions. Note: M (all) in the table refers to the calculated value of (Cr/52)/(C/4)+(Nb/93+Ti/48+V/51+Mo/96)/(C/12) in the composition.

As shown by Tables 1 to 3, when the contents of the alloying components such as C and Mn deviate from the scope of the present disclosure, for example, when the contents of C and Mn are lower, the yield strength of the steel of Comparative Examples J and K is less than 660 MPa, and the tensile strength is less than 780 MPa. When the contents of C and Mn are higher than the corresponding ranges defined for the inventive compositions, the hot-rolled structure contains a large amount of martensite, which will have a negative influence on the formability of the steel, and the reaming performance will deteriorate. This does not meet the purpose of the present disclosure. For example, the reaming rates of Comparative Examples I and L are both lower than that of the present disclosure.

When the content of the Ti element deviates from the scope of the present disclosure, the fatigue limit of the steel will be affected negatively. For example, Comparative Examples M, N, O, P may be mentioned. The Ti contents in Comparative Examples M and P are too high, so that their fatigue limits are much lower than 570 MPa, and their fatigue limit ratios are also much lower than the minimum design standard of 0.72, although the strength of the steel reaches the strength standard designed by the present disclosure. The Ti contents in Comparative Examples N and O are lower, but still exceed the upper limit defined by the present disclosure, so that their fatigue limits and fatigue limit ratios do not meet the requirements of the present disclosure. At the same time, in the compositional design of these two groups, the ratios of the alloying elements and the carbon element, namely M (all), do not fall in the range designed for the present disclosure, so that the reaming performance of these two groups of materials does not meet the standard.

As shown by Tables 2 to 3, when the final rolling temperature of the coil is rather low, such as in the case of Comparative Steel Samples A-2 and F-1 in Table 2, the reaming rate does not meet the design standard of the present disclosure. When the coiling temperature is higher than 550° C., pearlite structure and a large amount of carbide precipitates are generated, which deteriorates the reaming performance, such as in the case of Comparative Example F-2. In addition, in the case that the heat insulation and slow cooling technology is utilized, when the heat insulation temperature is too low, precipitation of carbides will be suppressed, resulting in insufficient steel strength. If the heat insulation time is too long, a large amount of coarse carbides will be generated, which has a negative influence on the reaming rate, such as in the case of Comparative Examples F-3, G-3 and H-3.

Figure 2:
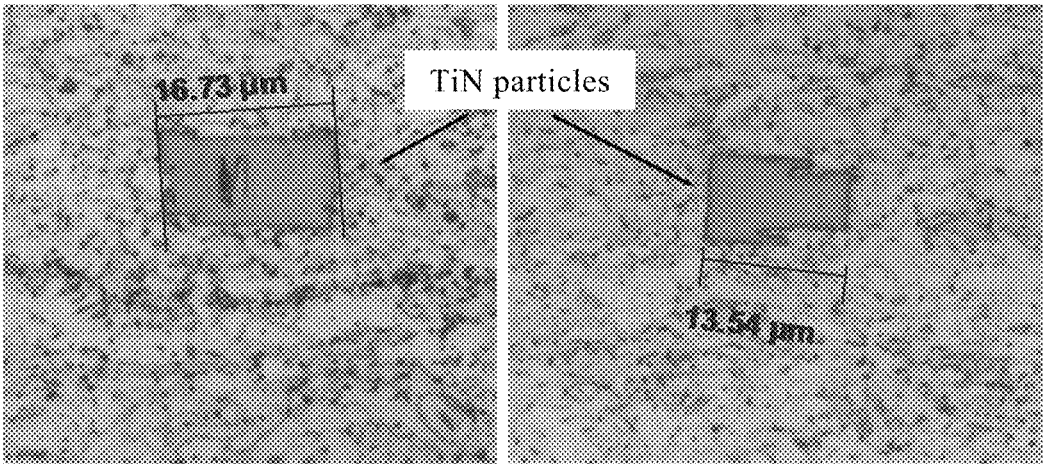
FIG. 2 is a photo showing the morphology of the TiN particles in the microstructure of the Comparative Example P steel (magnification: 1000).

As shown by FIG. 1, because the content of the Ti element in the G-1 steel is controlled to be extremely low, there are no large square TiN particles in the structure, and the carbide precipitates are mainly fine and dispersive (Mo, V) C. As shown by FIG. 2, because a design concept of strengthening with the help of the Ti element is employed for the Comparative P steel, large square TiN particles are often observed in the structure, and the grain boundaries have sharp corners. In addition, the precipitation phase of the Mo—V composite carbides in the inventive steel forms a fine and dispersive precipitation distribution (as shown in FIG. 1). In contrast, the TiC precipitation phase in the matrix of the Comparative P steel (black gray agglomerate, circular precipitates in the matrix) has a larger size, and the distribution is not uniform or dispersive (as shown in FIG. 2), thereby reducing the reaming performance of the material.

To sum up, by reasonably controlling the content ranges of the components, adding micro-alloying elements, and limiting the content of the Ti element on the basis of carbon-manganese steel, and further by controlling the coiling temperature on the basis of a conventional automotive steel production line, and still further by utilizing the heat insulation and slow cooling technology according to the present disclosure, an ultra-high-strength hot-rolled steel plate and an ultra-high-strength hot-rolled steel strip having good reaming and fatigue performances are produced, wherein the yield strength Rp0.2≥660 MPa, tensile strength Rm≥780 MPa, reaming rate≥85% (the original hole is a punched hole), reaming rate ≥120% (the original hole is a reamed hole), high frequency fatigue limit strength RL≤570 MPa, or tensile fatigue limit ratio RL/Rm≥0.72, suitable for manufacturing automobile chassis, suspension parts and other products.

TABLE 1

| | (unit: weight %) | | | | | | | | | | | | |
|---|---|---|---|---|---|---|---|---|---|---|---|---|---|
| | C | Si | Mn | P | N | Al | S | Nb | Ti | V | Cr | Mo | M(all) |
| Ex. A | 0.09 | 0.35 | 1.75 | 0.011 | 0.005 | 0.031 | 0.003 | 0.055 | 0.018 | 0.10 | 0.45 | 0.16 | 1.00 |
| Ex. B | 0.07 | 0.24 | 1.87 | 0.011 | 0.004 | 0.027 | 0.003 | 0.030 | 0.015 | 0.20 | 0.35 | 0.21 | 1.54 |
| Ex. C | 0.14 | 0.40 | 1.57 | 0.010 | 0.004 | 0.036 | 0.004 | 0.045 | 0.016 | 0.33 | 0.42 | 0.18 | 1.02 |
| Ex. D | 0.07 | 0.28 | 1.59 | 0.010 | 0.005 | 0.034 | 0.003 | 0.025 | 0.009 | 0.15 | 0.44 | 0.19 | 1.41 |
| Ex. E | 0.11 | 0.40 | 1.63 | 0.010 | 0.005 | 0.031 | 0.003 | 0.030 | 0.005 | 0.13 | 0.50 | 0.41 | 1.14 |
| Ex. F | 0.09 | 0.15 | 1.55 | 0.010 | 0.003 | 0.036 | 0.003 | 0.025 | 0.004 | 0.27 | 0.46 | 0.27 | 1.52 |
| Ex. G | 0.07 | 0.20 | 1.62 | 0.010 | 0.002 | 0.024 | 0.002 | 0.020 | 0.003 | 0.21 | 0.37 | 0.15 | 1.43 |
| Ex. H | 0.09 | 0.29 | 1.55 | 0.011 | 0.004 | 0.026 | 0.002 | 0.015 | 0.005 | 0.16 | 0.39 | 0.20 | 1.06 |
| Comp. Ex. I | 0.15 | 0.25 | 1.82 | 0.012 | 0.005 | 0.030 | 0.004 | 0.048 | 0.020 | 0.10 | 0.50 | 0.17 | 0.63 |
| Comp. Ex. J | 0.057 | 0.39 | 1.64 | 0.014 | 0.004 | 0.018 | 0.004 | 0.034 | 0.014 | 0.11 | 0.34 | 0.16 | 1.40 |
| Comp. Ex. K | 0.08 | 0.40 | 1.47 | 0.012 | 0.005 | 0.021 | 0.003 | 0.014 | 0.018 | 0.10 | 0.37 | 0.17 | 0.99 |
| Comp. Ex. L | 0.08 | 0.38 | 2.20 | 0.016 | 0.004 | 0.014 | 0.002 | 0.026 | 0.019 | 0.16 | 0.50 | 0.16 | 1.30 |
| Comp. Ex. M | 0.07 | 0.24 | 1.87 | 0.011 | 0.004 | 0.027 | 0.003 | 0.030 | 0.075 | | 0.35 | | 0.71 |
| Comp. Ex. N | 0.08 | 0.30 | 1.57 | 0.010 | 0.005 | 0.036 | 0.003 | 0.046 | 0.027 | 0.25 | 0.45 | 0.30 | 1.80 |
| Comp. Ex. O | 0.14 | 0.40 | 1.57 | 0.010 | 0.005 | 0.036 | 0.004 | 0.025 | 0.025 | 0.15 | 0.42 | 0.18 | 0.71 |
| Comp. Ex. P | 0.10 | 0.35 | 1.90 | 0.010 | 0.004 | 0.038 | 0.004 | 0.030 | 0.12 | 0.15 | 0.44 | 0.24 | 1.33 |

20

TABLE 2

| | Steel | Heating Temperature (° C.) | Final Rolling Temperature For Finish Rolling (° C.) | Cooling Rate (° C./s) | Coiling Temperature (° C.) | Heat Insulation And Slow Cooling (° C., h) |
|---|---|---|---|---|---|---|
| Ex. | A-1 | 1240 | 910 | 40 | 530 | No heat insulation |
| Comp. Ex. | A-2 | 1210 | 880 | 50 | 400 | No heat insulation |
| Ex. | B-1 | 1250 | 910 | 40 | 520 | No heat insulation |
| Ex. | B-2 | 1250 | 910 | 40 | 520 | 520, 4 |
| Ex. | C | 1220 | 900 | 50 | 450 | No heat insulation |
| Ex. | D | 1250 | 910 | 35 | 570 | No heat insulation |
| Ex. | E | 1250 | 920 | 45 | 510 | No heat insulation |
| Comp. Ex. | F-1 | 1190 | 870 | 30 | 500 | No heat insulation |
| Comp. Ex. | F-2 | 1230 | 900 | 30 | 600 | No heat insulation |
| Comp. Ex. | F-3 | 1250 | 920 | 40 | 450 | 420, 3 |
| Ex. | F-4 | 1240 | 910 | 40 | 550 | 510, 4 |
| Ex. | G-1 | 1250 | 920 | 45 | 520 | No heat insulation |
| Ex. | G-2 | 1230 | 910 | 40 | 520 | 500, 4 |
| Comp. Ex. | G-3 | 1240 | 910 | 40 | 520 | 500, 8 |
| Ex. | H-1 | 1230 | 900 | 40 | 530 | No heat insulation |
| Ex. | H-2 | 1230 | 900 | 40 | 530 | 500, 3 |
| Comp. Ex. | H-3 | 1220 | 900 | 40 | 530 | 500, 6 |
| Comp. Ex. | I | 1220 | 900 | 40 | 550 | No heat insulation |
| Comp. Ex. | J | 1230 | 910 | 40 | 450 | No heat insulation |
| Comp. Ex. | K | 1220 | 910 | 40 | 510 | No heat insulation |
| Comp. Ex. | L | 1250 | 920 | 40 | 550 | No heat insulation |
| Comp. Ex. | M | 1230 | 910 | 45 | 450 | No heat insulation |
| Comp. Ex. | N | 1210 | 900 | 40 | 520 | No heat insulation |
| Comp. Ex. | O | 1230 | 910 | 40 | 520 | No heat insulation |
| Comp. Ex. | P | 1220 | 910 | 40 | 520 | No heat insulation |

TABLE 3

| | Steel | Rp0.2 (MPa) | Rm (MPa) | A50(%) | FL (MPa) | FL/Rm | Reaming Rate Punched Hole (%) | Reaming Rate Reamed Hole (%) |
|---|---|---|---|---|---|---|---|---|
| Ex. | A-1 | 701 | 805 | 16.5 | 600 | 0.75 | 94.2 | 129.0 |
| Comp. Ex. | A-2 | 715 | 846 | 15.1 | 590 | 0.70 | 75.2 | 93.1 |
| Ex. | B-1 | 682 | 803 | 16.6 | 600 | 0.75 | 96.4 | 135.2 |
| Ex. | B-2 | 732 | 839 | 15.5 | 620 | 0.74 | 88.2 | 123.7 |
| Ex. | C | 763 | 870 | 15.1 | 610 | 0.70 | 85.2 | 120.6 |
| Ex. | D | 695 | 813 | 17.0 | 610 | 0.75 | 89.9 | 125.0 |
| Ex. | E | 720 | 825 | 16.2 | 620 | 0.75 | 87.8 | 122.7 |
| Comp. Ex. | F-1 | 707 | 809 | 17.5 | 600 | 0.74 | 79.8 | 113.4 |
| Comp. Ex. | F-2 | 738 | 848 | 14.8 | 590 | 0.70 | 70.3 | 88.0 |
| Comp. Ex. | F-3 | 652 | 777 | 18.0 | 570 | 0.73 | 88.3 | 108.9 |
| Ex. | F-4 | 749 | 842 | 15.5 | 630 | 0.75 | 86.5 | 120.5 |
| Ex. | G-1 | 671 | 788 | 17.8 | 630 | 0.80 | 97.7 | 129.8 |

TABLE 3-continued

| | Steel | Rp0.2 (MPa) | Rm (MPa) | A50(%) | FL (MPa) | FL/Rm | Reaming Rate Punched Hole (%) | Reaming Rate Reamed Hole (%) |
|---|---|---|---|---|---|---|---|---|
| Ex. | G-2 | 707 | 809 | 16.5 | 640 | 0.79 | 93.3 | 127.5 |
| Comp. Ex. | G-3 | 725 | 840 | 15.0 | 600 | 0.71 | 72.0 | 98.8 |
| Ex. | H-1 | 678 | 789 | 17.5 | 620 | 0.79 | 100.2 | 138.0 |
| Ex. | H-2 | 703 | 812 | 15.8 | 620 | 0.76 | 91.7 | 120.1 |
| Comp. Ex. | H-3 | 722 | 833 | 14.0 | 590 | 0.71 | 74.9 | 110.5 |
| Comp. Ex. | I | 703 | 916 | 15.1 | 570 | 0.62 | 75.4 | 98.9 |
| Comp. Ex. | J | 643 | 757 | 18.1 | 530 | 0.70 | 89.1 | 127.3 |
| Comp. Ex. | K | 657 | 764 | 16.5 | 540 | 0.71 | 84.8 | 118.0 |
| Comp. Ex. | L | 732 | 885 | 10.0 | 560 | 0.63 | 79.9 | 104.7 |
| Comp. Ex. | M | 718 | 842 | 13.5 | 540 | 0.64 | 61.6 | 88.2 |
| Comp. Ex. | N | 743 | 899 | 10.8 | 560 | 0.62 | 60.2 | 86.9 |
| Comp. Ex. | O | 775 | 934 | 9.0 | 560 | 0.60 | 50.2 | 77.1 |
| Comp. Ex. | P | 690 | 901 | 12.8 | 530 | 0.59 | 60.1 | 82.4 |

The invention claimed is:

1. A ultra-high-strength hot-rolled steel plate or steel strip with good fatigue and reaming performances, with a chemical composition based on weight percentage being: C: 0.07-0.14%, Si: 0.1-0.4%, Mn: 1.55-2.00%, P≤0.015%, S≤0.004%, Al: 0.01-0.05%, N≤0.005%, Cr: 0.15-0.50%, V: 0.1-0.35%, Nb: 0.01%-0.06%, Mo: 0.15-0.50%, and Ti≤0.02%, and a balance of Fe and unavoidable impurities, wherein the above elements meet the following relationship: 1.0≤[(Cr/52)/(C/4)+(Nb/93+Ti/48+V/51+Mo/96)/(C/12)] ≤1.6, wherein in a microstructure of the ultra-high-strength hot-rolled steel plate or steel strip, lower bainite has a content of 30%-70% by volume, and wherein the ultra-high-strength hot-rolled steel plate or steel strip has a tensile strength ≥780 MPa; a yield strength ≥660 MPa; a reaming rate performance index: a reaming rate >85% if an original hole is a punched hole; or a reaming rate >120% if an original hole is a reamed hole; and a fatigue resistance performance index: a high frequency fatigue limit after 10 million cycles FL≥570 MPa, or a ratio of fatigue limit to tensile strength FL/Rm≥0.72.

2. The ultra-high-strength hot-rolled steel plate or steel strip with good fatigue and reaming performances according to claim 1, wherein in the chemical composition of the ultra-high-strength hot-rolled steel plate or steel strip, C: 0.07-0.09% based on weight percentage.

3. The ultra-high-strength hot-rolled steel plate or steel strip with good fatigue and reaming performances according to claim 1, wherein in the chemical composition of the ultra-high-strength hot-rolled steel plate or steel strip, Si: 0.1-0.3% based on weight percentage.

4. The ultra-high-strength hot-rolled steel plate or steel strip with good fatigue and reaming performances according to claim 1, wherein in the chemical composition of the ultra-high-strength hot-rolled steel plate or steel strip, Mn: 1.70-1.90% based on weight percentage.

5. The ultra-high-strength hot-rolled steel plate or steel strip with good fatigue and reaming performances according to claim 1, wherein in the chemical composition of the ultra-high-strength hot-rolled steel plate or steel strip, Cr: 0.35-0.50% based on weight percentage.

6. The ultra-high-strength hot-rolled steel plate or steel strip with good fatigue and reaming performances according to claim 1, wherein in the chemical composition of the ultra-high-strength hot-rolled steel plate or steel strip, V: 0.12-0.22% based on weight percentage.

7. The ultra-high-strength hot-rolled steel plate or steel strip with good fatigue and reaming performances according to claim 1, wherein in the chemical composition of the ultra-high-strength hot-rolled steel plate or steel strip, Mo: 0.15-0.3% based on weight percentage.

8. The ultra-high-strength hot-rolled steel plate or steel strip with good fatigue and reaming performances according to claim 1, wherein in the chemical composition of the ultra-high-strength hot-rolled steel plate or steel strip, Ti≤0.005% based on weight percentage.

9. The ultra-high-strength hot-rolled steel plate or steel strip with good fatigue and reaming performances according to claim 1, wherein in the chemical composition of the ultra-high-strength hot-rolled steel plate or steel strip, Ti≤0.003%, N≤0.003% based on weight percentage.

10. The ultra-high-strength hot-rolled steel plate or steel strip with good fatigue and reaming performances according to claim 1, wherein the ultra-high-strength hot-rolled steel plate or steel strip has a tensile strength ≥780 MPa; a yield strength ≥660 MPa; a reaming rate performance index: a reaming rate >85% if the original hole is a punched hole; or a reaming rate >120% if the original hole is a reamed hole; and a fatigue resistance performance index: a high frequency fatigue limit after 10 million cycles FL≥600 MPa, or a ratio of fatigue limit to tensile strength FL/Rm≥0.75.

11. The ultra-high-strength hot-rolled steel plate or steel strip with good fatigue and reaming performances according to claim 1, wherein the ultra-high-strength hot-rolled steel plate or steel strip has a fatigue resistance performance index: a high frequency fatigue limit after 10 million cycles FL≥640 MPa, or a ratio of fatigue limit to tensile strength FL/Rm≥0.8.

12. A method for manufacturing the ultra-high-strength hot-rolled steel plate or steel strip with good fatigue and reaming performances according to claim 1, comprising:

1) Smelting and casting the chemical composition according to claim 1;
2) Rolling, wherein a heating temperature is 1100-1250° C.; an initial rolling temperature for finish rolling is 950-1000° C., and a final rolling temperature for finish rolling is 900-950° C.;
3) Cooling, wherein a cooling rate is ≥30° C./s; and a coiling temperature is 450-580° C.; and
4) Pickling.

13. The method for manufacturing the ultra-high-strength hot-rolled steel plate or steel strip with good fatigue and reaming performances according to claim 12, wherein after the cooling and coiling in Step 3), the method further includes heat insulation and slow cooling, wherein a temperature is controlled at 450° C. or higher for 2-4 hours.

14. The ultra-high-strength hot-rolled steel plate or steel strip with good fatigue and reaming performances according to claim 8, wherein the ultra-high-strength hot-rolled steel plate or steel strip has a tensile strength ≥780 MPa; a yield strength ≥660 MPa; a reaming rate performance index: a reaming rate >85% if the original hole is a punched hole; or a reaming rate>120% if the original hole is a reamed hole; and a fatigue resistance performance index: a high frequency fatigue limit after 10 million cycles FL≥600 MPa, or a ratio of fatigue limit to tensile strength FL/Rm≥0.75.

15. The ultra-high-strength hot-rolled steel plate or steel strip with good fatigue and reaming performances according to claim 9, wherein the ultra-high-strength hot-rolled steel plate or steel strip has a fatigue resistance performance index: a high frequency fatigue limit after 10 million cycles FL≥640 MPa, or a ratio of fatigue limit to tensile strength FL/Rm≥0.8.

16. The method for manufacturing the ultra-high-strength hot-rolled steel plate or steel strip with good fatigue and reaming performances according to claim 12, wherein in the chemical composition of the ultra-high-strength hot-rolled steel plate or steel strip, C: 0.07-0.09%, Si: 0.1-0.3%, Mn: 1.70-1.90%, Cr: 0.35-0.50%, V: 0.12-0.22%, Mo: 0.15-0.3%, and Ti≤0.005%, based on weight percentage.

* * * * *